US006013909A

United States Patent [19]

Aramaki et al.

[11] Patent Number: 6,013,909

[45] Date of Patent: Jan. 11, 2000

[54] PORTABLE MICROWAVE OVEN HAVING A DOOR WITH STIRRER

[75] Inventors: Yoshihiro Aramaki, Nara; Kiyoto Fushino, Osaka, both of Japan

[73] Assignee: Sharp Kabushiki Kaisha, Osaka, Japan

[21] Appl. No.: 08/966,450

[22] Filed: Nov. 7, 1997

[30] Foreign Application Priority Data

Mar. 10, 1997 [JP] Japan ..... 9-054444
Mar. 11, 1997 [JP] Japan ..... 9-056436

[51] Int. Cl.[7] ..... H05B 6/74

[52] U.S. Cl. ..... 219/751; 219/757; 219/739

[58] Field of Search ..... 219/751, 757, 219/756, 739

[56] References Cited

U.S. PATENT DOCUMENTS 3,531,950 10/1970 Foerstner ..... 219/751
3,991,295 11/1976 Akiyoshi .
4,330,696 5/1982 Pomeroy et al. .
4,743,728 5/1988 Nagafusa et al. ..... 219/751
4,762,973 8/1988 Schultz ..... 219/725
4,764,651 8/1988 Schwartz ..... 219/751
5,097,106 3/1992 Arai et al. .
5,369,255 11/1994 Sherer et al. .
5,714,740 2/1998 Kelly et al. .

*Primary Examiner*—Philip H. Leung

[57] ABSTRACT

A portable microwave oven includes: electrical components for generating microwaves; a heating chamber for food to be heat cooked; and a door for allowing food to be put in and taken out from the heating chamber. The door incorporates a microwave stirrer for agitating microwaves. When food is heated, the user takes the tray out from the heating chamber so as to place food and then can easily put the food together with the tray by holding the handle of the tray. Similarly, when food is taken out, it is taken out together with the tray.

12 Claims, 6 Drawing Sheets

PORTABLE MICROWAVE OVEN HAVING A DOOR WITH STIRRER

BACKGROUND OF THE INVENTION (1) Field of the Invention

The present invention relates to a portable microwave oven which can be carried outdoors.

(2) Description of the Prior Art

Conventionally, microwave ovens for home-use counter top type have been prevalent on the market and occupy a suitable area in kitchens. In recent years, however, with drastic expansion of the automobile industry as well as the outdoor leisure industry, there have been a demand for microwave ovens for cooking outdoors base on the tendency to seek various leisure-oriented lives. In response to this tendency, portable microwave ovens of a light-weight type which can be carried outdoors with ease have been developed.

In general, microwave ovens have a turntable which turns food or a metal-made agitator for agitating microwaves in the power feeding portion of microwaves to the heating chamber letting the food stand still, so that microwaves will uniformly heat food when it is heated.

However, when these methods are applied to portable microwave ovens, it is necessary to ensure a heating chamber having some degree of volume, unavoidably increasing the apparatus size. Conversely, when the body is reduced in size, there is no space for equipment of the apparatus for uniformly heating food, producing a problem of large uneven distribution during heating. Because of frequent carriage from place to place, this type of microwave oven needs increased strength against vibration.

Further, in portable microwave ovens mainly used outdoors, the door for allowing the user to put food into and take it out of the heating chamber is provided on the top of the apparatus body with a food tray placed on the bottom of the heating chamber. This arrangement, however, has given rise a problem of bad handling when the user puts food on the tray inside the heating chamber or when the user takes food from the heating chamber after heating.

SUMMARY OF THE INVENTION

The present invention has been devised in order to solve the above problems and it is therefore an object of the present invention to provide a portable microwave oven which can cook food without uneven heat distribution, without increasing the size of the portable microwave oven body and which is improved in strength against vibrations.

In addition to the above solution of the conventional problems, it is another object of the invention to provide a portable microwave oven which is improved in user's handling performance, allowing the user to put food into, and take food out of, the heating chamber.

In order to achieve the above objects, the present invention is configurated as follows:

In accordance with the first aspect of the invention, a portable microwave oven includes: electrical components for generating microwaves; a heating chamber for food to be heat cooked; and a door for allowing food to be put in, and taken out, from the heating chamber, and is characterized in that the door has a microwave stirrer for agitating microwaves incorporated therein.

In accordance with the second aspect of the invention, the portable microwave oven having the above first feature further includes: a cooling fan for cooling the electrical components; and a motor for rotating the cooling fan and is characterized in that the air flow generated by the rotation of the cooling fan driven by the motor is used to rotate the microwave stirrer.

In accordance with the third aspect of the invention, the portable microwave oven having the above second feature is characterized in that the air flow which has rotated the microwave stirrer is conducted into the heating chamber through an air duct which is formed in a cover provided for the door so as to wrap around the microwave stirrer and is discharged from the heating chamber to the exterior thereof, together with steam generated from heated food.

In accordance with the fourth aspect of the invention, the portable microwave oven having the third feature is characterized in that the cover has an air guide which directs the air flow to allow the microwave stirrer to rotate smoothly.

In accordance with the fifth through eighth aspects of the invention, the portable microwave oven having any one of the above first through fourth features is characterized in that the bearing for supporting the microwave stirrer comprises a pair of sockets disposed above and below.

In accordance with the ninth aspect of the invention, a portable microwave oven includes: electrical components for generating microwaves; a heating chamber for food to be heating cooked; a door for allowing food to be put in, and taken out, from the heating chamber; and a tray set inside the heating chamber for allowing food to be placed thereon, and is characterized in that handles for allowing the tray to be put in, and taken out from, the heating chamber are attached to the tray.

In accordance with the tenth aspect of the invention, the portable microwave oven having the ninth feature is characterized in that when the door is closed, the handles abut the door so that the tray is tightly placed inside the heating chamber.

In accordance with the eleventh and twelfth aspects of the invention, the portable microwave oven having the above ninth or tenth feature is characterized in that the handles are rotated 180 degrees relative to the tray.

In accordance with the thirteenth and fourteenth aspects of the invention, the portable microwave oven having the above ninth or tenth feature is characterized in that leg structures each having two different-sized legs projected above and below are provided near the periphery of the tray, the pivot axles of the handles are positioned at the center, equi-distant from two ends of the legs, so that the handles are rotated about the axles 180 degrees relative to the tray.

In accordance with the fifteenth and sixteenth aspects of the invention, the portable microwave oven having the above ninth or tenth feature is characterized in that the handles each have a plurality of indentations and the tray is attached to one of the indentation.

BRIEF DESCRIPTION OF THE DRAWINGS

FIG. 8A is a partial sectional view showing a state where a tray is attached to the indentations formed at a lower height of handles and FIG. 8B is a partial sectional view showing a state where a tray is attached to the indentations formed at a upper height of handles.

DESCRIPTION OF THE PREFERRED EMBODIMENTS

Now, the embodiments of a portable microwave oven of the invention will hereinafter be described with reference to the accompanying drawings.

Figure 1A:
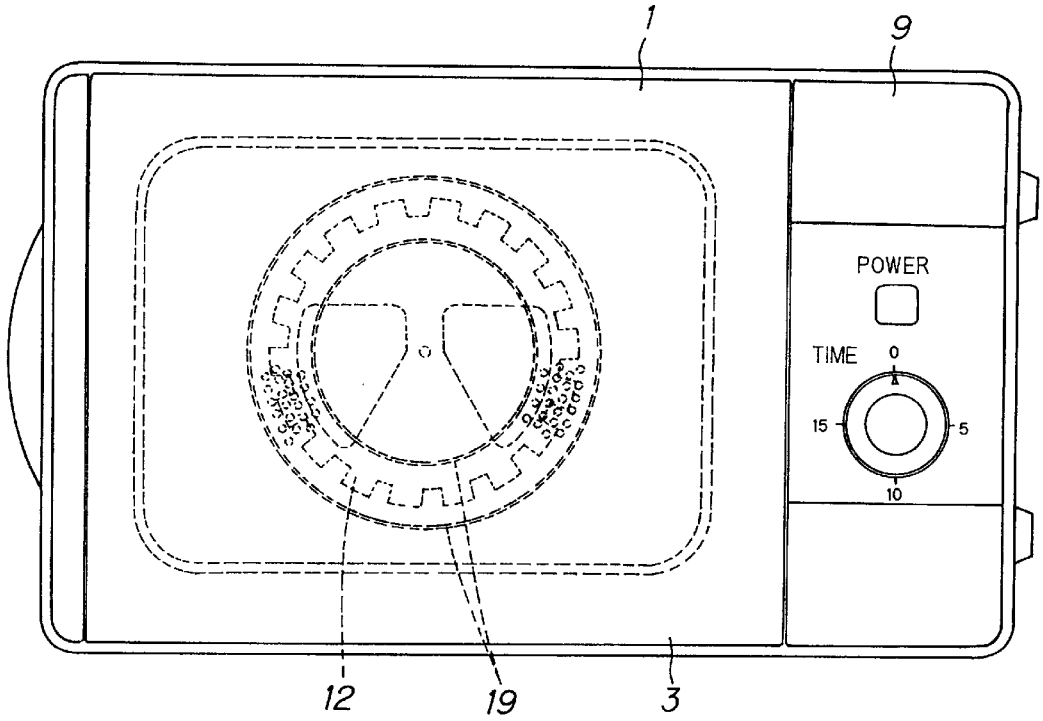
FIGS. 1A and 1B are views showing the appearance of an embodiment of a portable microwave oven in accordance with the invention, FIGS. 1A and 1B being top and side views, respectively.
Figure 1B:
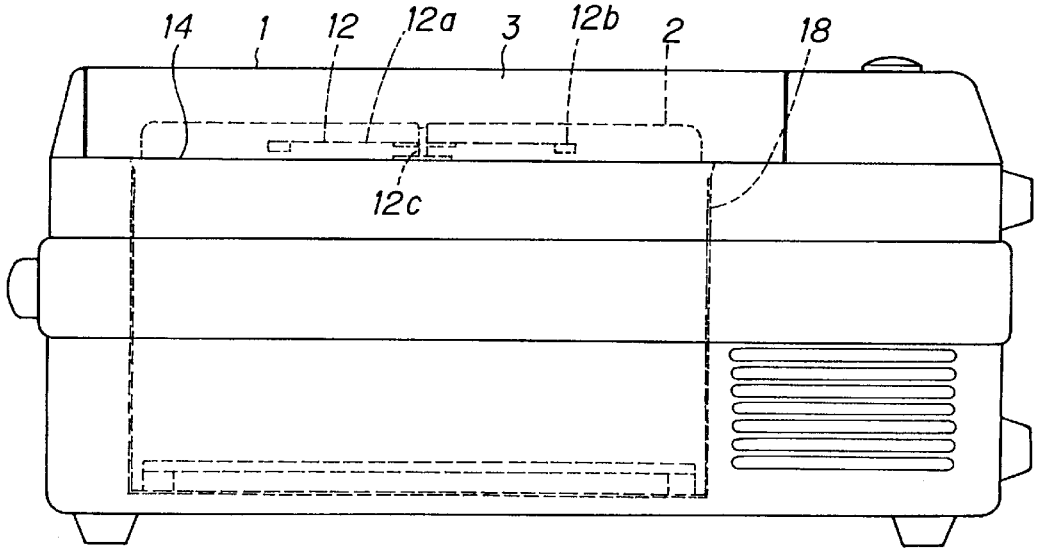
Figure 2:
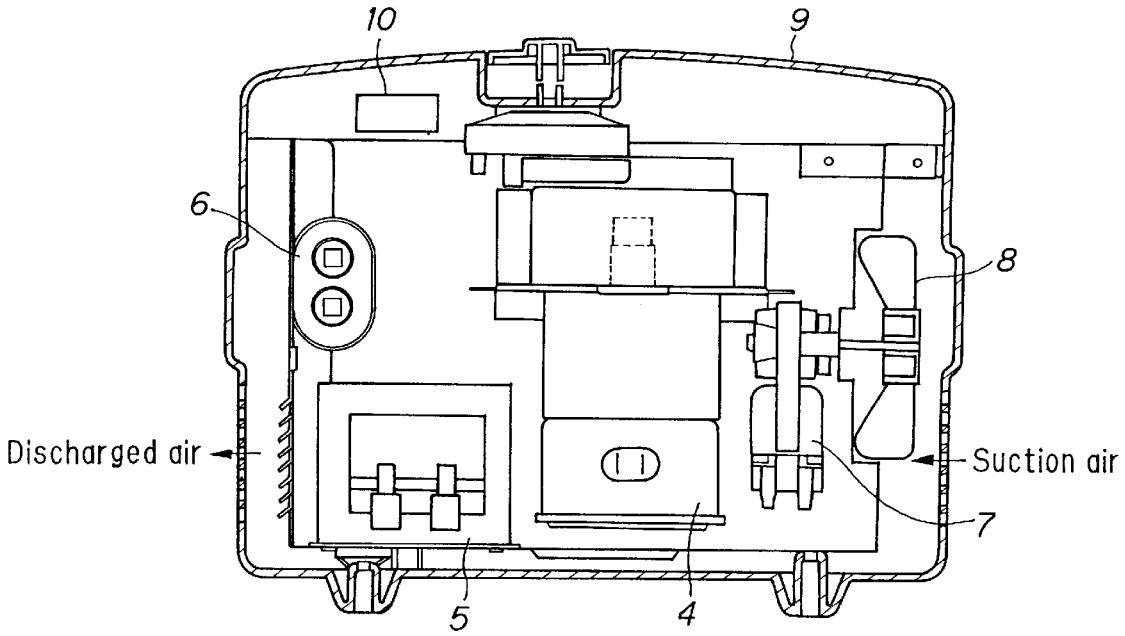
FIG. 2 is a sectional view showing electrical components accommodated inside the portable microwave oven shown in FIGS. 1A and 1B.
Figure 3:
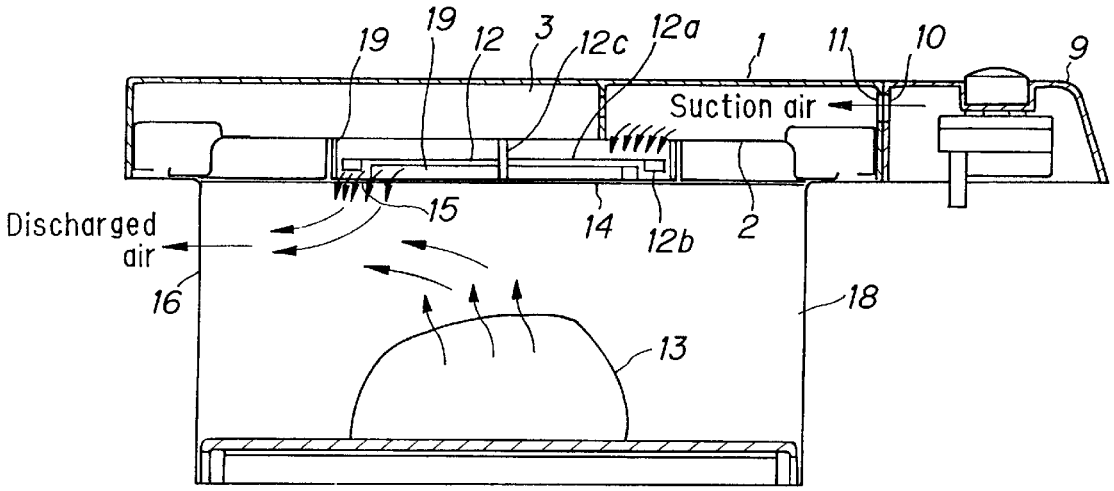
FIG. 3 is a partial sectional view showing the portable microwave oven shown in FIGS. 1A and 1B.

FIGS. 1A and 1B are views showing the appearance of an embodiment of a portable microwave oven in accordance with the invention; FIGS. 1A and 1B being top and side views, respectively. FIG. 2 is a sectional view showing electrical components accommodated inside the portable microwave oven shown in FIGS. 1A and 1B. FIG. 3 is a partial sectional view showing the portable microwave oven shown in FIGS. 1A and 1B.

As shown in FIGS. 1A and 1B, a door 1 for allowing food to be put in and taken out therethrough as well as shielding radiation of microwaves is provided on the top of the portable microwave oven. This door can pivot so that it can open and be closed. Door 1 has a door panel 2 made of metal for shielding radiation of microwaves, a door frame 3 made of plastic constituting the outer covering, and a latch mechanism for locking door 1.

Referring to FIG. 2, when a motor 7 is driven, a cooling fan 8 that is fixed to the shaft of motor 7 starts to rotate. This rotation of cooling fan 8 sucks air from an air suction port and part of the air is conducted to cool the electrical components for generating microwaves, including a magnetron 4, a high-voltage transformer 5, a high-voltage capacitor 6 etc., and is discharged from a discharging port.

Part of the air flow generated by the rotation of cooling fan 8 is conducted through a heating chamber suction port 10 on the side surf ace of a control panel 9 and a suction port 11 provided on the door 1 shown in FIG. 3 so as to rotate a microwave stirrer 12 for agitating microwaves. This microwave stirrer 12 is made up of a light-weighted, microwave-reflective metal material such as aluminum etc.

Microwave stirrer 12 is composed of a disc-like flat branching portion 12*a* having amorphous holes therein, a fin portion 12*b* having bends angled at approximately 90 degrees on the periphery of flat branching portion 12*a* and a bearing 12*c* serving as supports and a rotational center of microwave stirrer 12. The air flow from cooling fan 7 hits fin portion 12*b* so as to generate torque for rotating microwave stirrer 12.

Provided for door 1 is a cover 14 which covers microwave stirrer 12. This cover has an air guide 19 along fin portion 12*b*, as shown in FIGS. 1A and 1B so that the air flow will transmit torque to fin portion 12*b* more efficiently. In this way, food 13 can be uniformly heated avoiding uneven heating. Since microwave stirrer 12 is arranged in the draw-formed portion of door panel 2, this configuration enables uniform heating of food without either increasing the microwave oven body in its size or reducing the effective dimensions of heating chamber 18.

Conventionally, home-use microwave ovens usually have a door with a screen window. On the other hand, since portable microwave ovens are inherently designed to be compact, they generally have no window (view-finder) in door 1. It is further reasoned that a portable microwave oven is often used in light filled places other than home kitchen and if a view-finder is provided, the range of the view-finder is small and cannot give a good interior view because the surrounding is too bright. Therefore, there is nothing to obstruct the use of microwave stirrer 12 being arranged in the center of door panel 2.

The air flow which has turned microwave stirrer 12 is sent, as shown in FIG. 3, into heating chamber 18 through an air duct 15 formed in cover 14, which is provided for door 1 in order to prevent the user from touching microwave stirrer 12 when cleaning or the like. The thus supplied air to the heating chamber is discharged from a discharging port 16 provided in heating chamber 18, capturing steam generated from food during heating. Since steam is discharged in the above manner, heating chamber 18 does not need to have a dedicated air duct (such as punched holes etc.) for feeding air into heating chamber 18, thus making it possible to simplify the die and reduce the number of steps for manufacturing.

Figure 4:
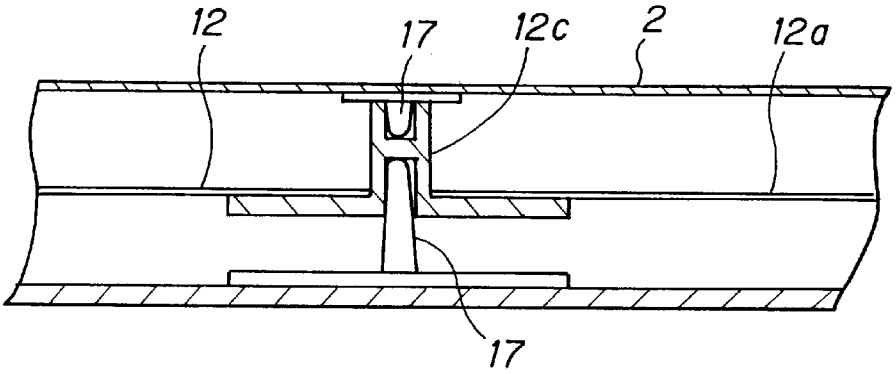
FIG. 4 is an enlarged view showing bearings disposed above and below a microwave stirrer.

A pair of shafts 17 for supporting microwave stirrer 12 are provided, one fixed on the top surface of cover 14 and the other on the inner side of door panel 2, while bearing 12*c* of microwave stirrer 12 has a pair of sockets above and below as shown in FIG. 4. This structure protects removal of microwave stirrer 12 from shafts 17 during hand carriage or transportation by car. Bearing 12*c* is made up of a plastic material having a low frictional coefficient, such polytetrafluoroethylene (Teflon) in order to permit smooth rotation. Cover 14 is formed of a plastic material having a low induction ratio such as polypropylene.

Figure 5:
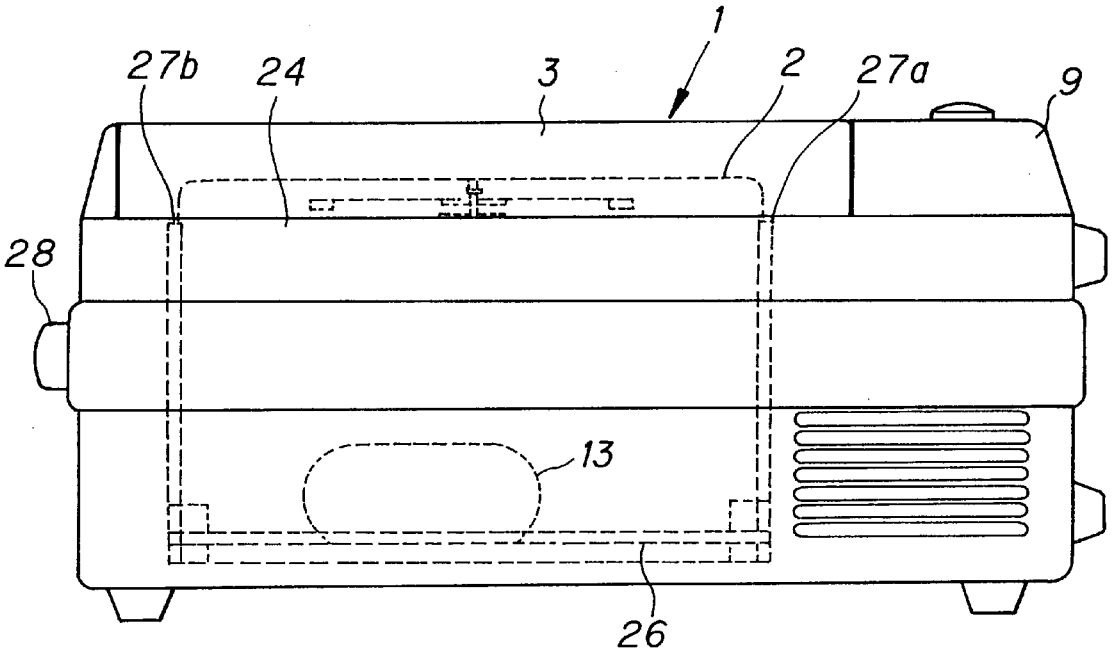
FIG. 5 is a side view showing another embodiment of a portable microwave oven in accordance with the invention.

Next, FIG. 5 is a side view showing another embodiment of a portable microwave oven of the invention. Description of the components in common with those in FIGS. 1A and 1B will be omitted.

In this embodiment, a pair of handles 27 (27*a* and 27*b*) are pivotally provided on the sides of a tray 26. In the event of heating food 13, first the user holds handles 27 and lifts them up to take tray 26 out from a heating chamber 24. The user then places food 13 on tray 26 and can put tray 26 together with food 13 into heating chamber 24 by holding handles 27. On the occasion of taking out food 13, tray 26 with the food can be taken out altogether. In this way, the handling performance is improved.

Figure 6:
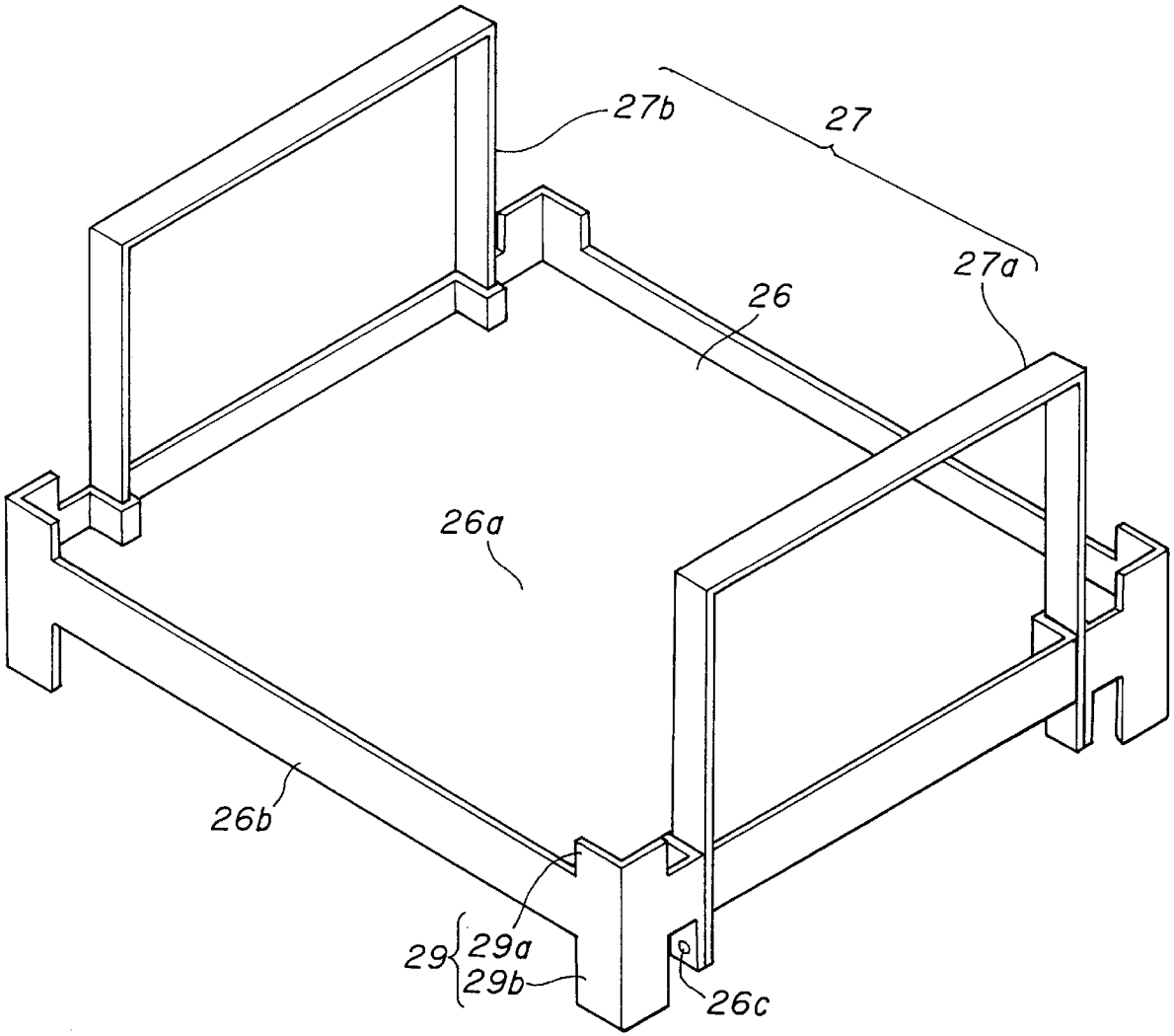
FIG. 6 is a perspective view showing a tray having handles 180 degrees rotatable, attached thereto.

FIG. 6 is a perspective view showing tray 26 having handles 27 attached thereto. Tray 26 has a flat portion 26*a* having a rectangular shape. The pair of handles 27*a* and 27*b* are engaged with tray 26 at pins 26*c* so that they can rotate 180 degrees with respect to the tray. Flat portion 26*a* is marginally smaller than the bottom face of heating chamber 24. Food 13 is placed on flat portion 26*a*. An outer rim 26*b* is provided around the periphery of flat portion 26*a*. This outer rim 26*b* is provided to prevent drips or food crumbs from directly dropping to the bottom of heating chamber 24, trying to improve cleanability of heating chamber 24.

Tray 26 and handles 27 are formed of plastic molding, which is light, since they are equipped in a portable microwave oven. The top faces of handles 27 are designed to be as high as the top plane of heating chamber 24 so that they will be in contact with the door panel when door 1 is closed. When the microwave oven body is carried, it is held by a carrying handle 28. Therefore, control panel 9 is oriented downward. Handles 27 provided for tray 26 are made in close contact with door 1 as shown in FIG. 6, whereby it is possible to transport the oven with the tray being unchattered and fixed therein.

Figure 7B:
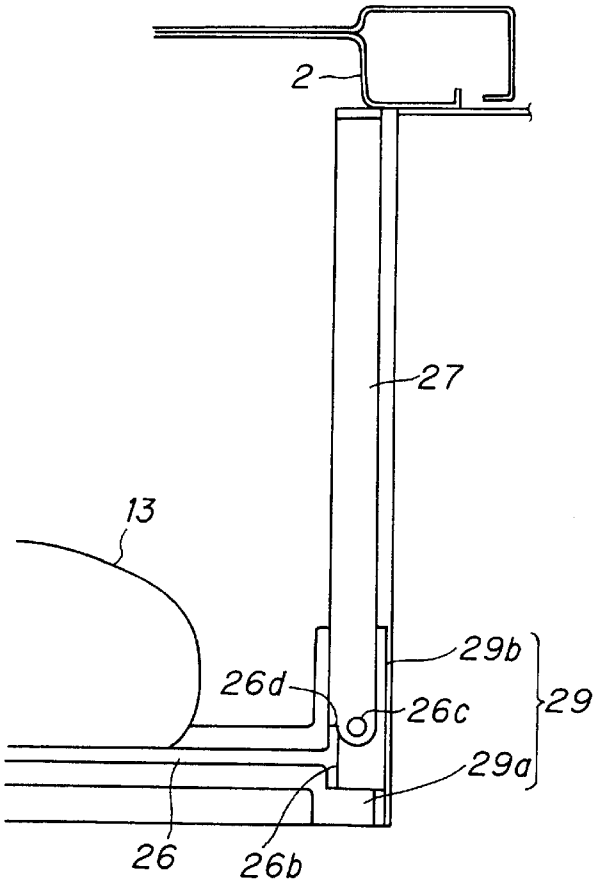
FIGS. 7A and 7B are sectional view showing a part of the portable microwave oven shown in FIG. 5, FIGS. 7A and 7B being partial sectional views when a tray is positioned at a upper height and where a tray is positioned at a lower height.
Figure 7A:
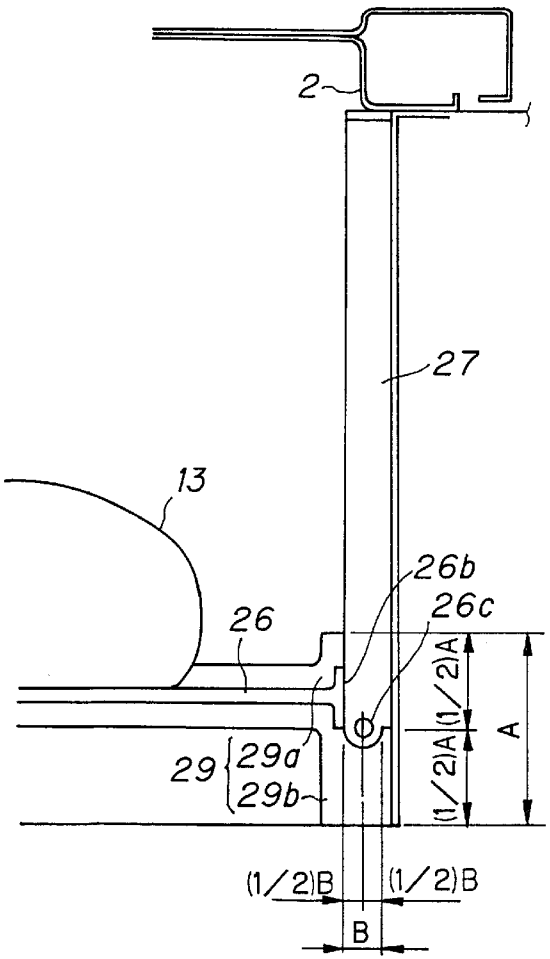

FIGS. 7A and 7B show two states of tray 26 where handles 27 are rotated 180 degrees from one state to the other. Provided at each of the four corners of rectangular tray 26 is a leg structure 29 which has two different-sized legs 29*a* and 29*b* formed integrally extending opposite to each other (see FIG. 6). Pin 26*c* serving as a rotational center of handle 27 is provided at a point positioned at half the height of leg structure 29 and half the length B which is the width of handle 27 minus the wall thickness of its outer rim. In FIG. 7A, the outer rim 26*b* of tray 26 functions as the stopper for handle 27 so as to prevent the handle from falling inward to heating chamber 24. On the other hand, in FIG. 7B, the end face 26*d* of outer rim 26*b* of tray 26 functions as the stopper for handle 27 so as to prevent the handle from falling inward to heating chamber 24.

In this way, handles 27 are assembled to leg structures 29 which each have two different height legs projected from tray 26, at the predetermined positions so that they can pivotally move at the outer periphery of tray 26. With this structure, the plate face of tray 26 is reversed when handles 27 are rotated 180 degrees, so that it is possible to change the height of the drip plate surface on which food is placed in tray 26, which allows the user to select the height of tray 26. Further, the manufacturer can indicate the height of tray 26 in accordance with the type of food so that the food may be heated uniformly.

As a result, when the user selects the lower height of tray 26, it is possible to put taller food in heating chamber 24. Conversely, when the user selects the upper height of tray 26, food can be placed in a shallow position inside heating chamber 24 and hence food can be readily put in and taken out directly without putting in and taking out tray 26.

Since the rotational axle of handle 27 is disposed at the vertical center of leg structure 29 having different-sized legs, handles 27 will abut door 1 in either case, where tray 26 is placed at the upper position and where it is placed at the lower position. This means that tray 26 can always be tightly held inside heating chamber 24. Also for the packaging step at the production line, this configuration lends itself to omitting the stuffing for fixing tray 26 and hence results in reduction in cost.

Figure 8B:
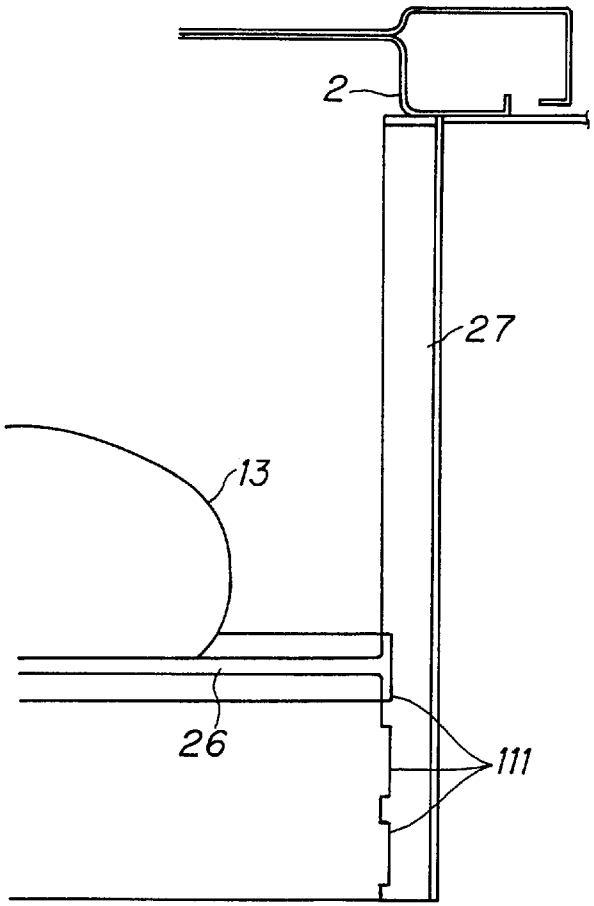
FIGS. 8A and 8B are partial sectional views showing another embodiment of a portable microwave oven in accordance with the invention.
Figure 8A:
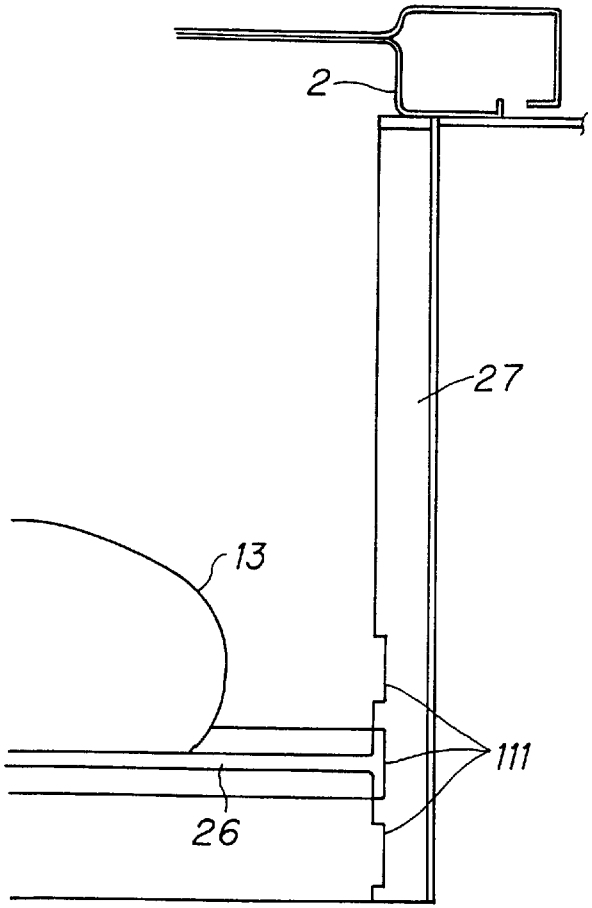

FIGS. 8A and 8B are partial sectional views showing another embodiment of a portable microwave oven in accordance with the invention, where handles 27 and tray 26 can be assembled and disassembled. Specifically, as shown in FIGS. 8A and 8B, a plurality of indentations 111 are formed in handle 27. In this structure, the position of tray 26 can be adjusted to several levels of height in accordance with the number of indentations 111. Further, whichever height is selected, handles 27 abut door 1 (door panel 2) so that tray 26 will not chatter as in the above even when the microwave oven body is transported.

The portable microwave oven of the invention thus configured has advantages as follows:

In accordance with the portable microwave oven having the above first feature, since a microwave stirrer for agitating microwaves is provided in the door for allowing food to be put in and taken out therethrough, it is possible to uniformly heat food, assuring an effective size for the heating chamber without enlarging the outside dimensions of microwave oven body.

In accordance with the portable microwave oven having the above second feature, since the air flow generated by the rotation of the cooling fan is used to drive the microwave stirrer, it is possible to turn the microwave stirrer without increasing the number of parts such as a motor etc. for driving a microwave agitator.

In accordance with the portable microwave oven having the above third feature, the air flow which has turned the microwave stirrer is introduced into the heating chamber through an air duct provided for the cover, without being discharged directly, it is possible to simplify the exhaust system. Further, since an air duct is provided for the cover, no duct for air to be injected into the heating chamber needs to be provided for in the wall of the heating chamber, it is possible to simplify the die for producing the heating chamber and hence reduce the number of the production steps.

In accordance with the portable microwave oven having the above fourth feature, since an air guide is provided in the cover, it is possible to guide air flow to smoothly rotate the microwave stirrer. Further, this structure improves the strength of the cover, resulting in improvement in quality.

In accordance with the portable microwave oven having the above fifth through eighth features, since the bearing has a pair of sockets above and below for supporting the microwave stirrer, rotational vibrations of the microwave stirrer can be eliminated. Further, this configuration is strongly resistant to vibrations during transportation.

In accordance with the portable microwave oven having the above ninth feature, since the tray has handles for allowing the tray to be put into, and taken out of, the heating chamber, food can be put into, and taken out of the heating chamber together with the tray. This means that the user will not directly touch hot food which has been heated, and hence will have no risk of being burned or other danger.

In accordance with the portable microwave oven having the above tenth feature, since the handles abut the door when the door is closed, the tray can be fixed inside the heating chamber and hence can be prevented from being chattered during carriage or transportation of the portable microwave oven. Also in the packaging step at the production line, this configuration lends itself to omitting the stuffing for fixing the tray and hence results in reduction in cost.

In accordance with the portable microwave oven having the above eleventh and twelfth features, since the handles can be rotated 180 degrees relative to the tray, it is possible to change the height of the tray on which food is placed and hence it becomes possible to heat food uniformly in a more spatial manner compared to typical configurations in which food is uniformly heated in a planar manner using a turntable or stirrer fan. For example, popcorn is well cooked when it is placed away from the wall surface of the heating chamber by setting the tray may at the higher position. Alternatively, the tray is set at the lower position for a more usual menu so as to use large space. In this way, this configuration allows the selection of optimal cooking conditions in accordance with the food.

In accordance with the portable microwave oven having the above thirteenth and fourteenth features, the pivot axles of the pivotable handles attached to the tray are positioned at the vertical center, equi-distant from two ends of the leg structure having different-sized legs which project above and below near the periphery of the tray. By this configuration, either when the tray surface is set at the higher position or when the tray surface is set at the lower position, the handles can be abutted against the door, thus the tray can always be fixed tightly during carriage or transportation. Also in the packaging step at the production line, this configuration lends itself to omitting the stuffing for fixing the tray and hence results in reduction in cost.

In accordance with the portable microwave oven having the above fifteenth and sixteenth features, since a plurality of indentations are formed in the handles and the tray can be attached to any one of them, either when the tray surface is set at a higher position or when the tray surface is set at a lower position, the handles can be abutted against the door, thus the tray can always be fixed tightly during carriage or transportation. Also in the packaging step at the production line, this configuration lends itself to omitting the stuffing for fixing the tray and hence results in reduction in cost.

What is claimed is:

1. A portable microwave oven comprising:

electrical components for generating microwaves;

a heating chamber for food to be heat cooked; and a door for allowing food to be put in, and taken out, from the heating chamber, a microwave stirrer for agitating microwaves incorporated in the oven and operatively connected to the door, wherein the microwave stirrer is composed of a disc flat branching portion having amorphous holes.

2. The portable microwave oven according to claim 1 further comprising: a cooling fan for cooling the electrical components; and a motor for rotating the cooling fan, wherein the air flow generated by the rotation of the cooling fan driven by the motor is used to rotate the microwave stirrer.

3. The portable microwave oven according to claim 2, further including a bearing for supporting the microwave stirrer the bearing having a pair of sockets each having an open end facing in opposite directions.

4. The portable microwave oven according to claim 3, further including a shaft fixed on the top surface of a cover and inserted into an open end of one of the sockets, and a shaft attached to a side of a door panel and inserted into an open end of the other socket.

5. A portable microwave oven comprising:

electrical components for generating microwaves;

a heating chamber for food to be heat cooked; and a door for allowing food to be put in, and taken out, from the heating chamber, the door has a microwave stirrer for agitating microwaves incorporated in the oven, a cooling fan for cooling the electrical components; and a motor for rotating the cooling fan, wherein the air flow generated by the rotation of the cooling fan driven by the motor is used to rotate the microwave stirrer; and the air flow which has rotated the microwave stirrer is conducted into the heating chamber through an air duct which is formed in a cover provided for the door so as to wrap around the microwave stirrer and is discharged from the heating chamber to the exterior thereof, together with steam generated from heated food.

6. The portable microwave oven according to claim 5, wherein the cover has an air guide which directs the air flow to allow the microwave stirrer to rotate smoothly.

7. The portable microwave oven according to claim 6, further including a bearing for supporting the microwave stirrer the bearing having a pair of sockets each having an open end facing in opposite directions.

8. The portable microwave oven according to claim 7, further including a shaft fixed on the top surface of a cover and inserted into an open end of one of the sockets, and a shaft attached to a side of a door panel and inserted into an open end of the other socket.

9. The portable microwave oven according to claim 5, further including a bearing for supporting the microwave stirrer the bearing having a pair of sockets each having an open end facing in opposite directions.

10. The portable microwave oven according to claim 9, further including a shaft fixed on the top surface of a cover and inserted into an open end of one of the sockets, and a shaft attached to a side of a door panel and inserted into an open end of the other socket.

11. A portable microwave oven comprising:

electrical components for generating microwaves;

a heating chamber for food to be heat cooked; and a door for allowing food to be put in, and taken out, from the heating chamber, the door has a microwave stirrer for agitating microwaves incorporated in the oven, further including a bearing for supporting the microwave stirrer the bearing including a pair of sockets each socket having an open end facing in opposite directions.

12. The portable microwave oven according to claim 11, further including a shaft fixed on the top surface of a cover and inserted into an open end of one of the sockets, and a shaft attached to a side of a door panel and inserted into an open end of the other socket.

* * * * *